US006263638B1

(12) United States Patent
Long, Sr.

(10) Patent No.: US 6,263,638 B1
(45) **Date of Patent: *Jul. 24, 2001**

(54) INSULATED INTEGRAL CONCRETE WALL FORMING SYSTEM

(75) Inventor: Robert T. Long, Sr., Ames, IA (US)

(73) Assignee: Composite Technologies Corporation, Ames, IA (US)

( * ) Notice: Subject to any disclaimer, the term of this patent is extended or adjusted under 35 U.S.C. 154(b) by 0 days.

(21) Appl. No.: 09/334,826

(22) Filed: Jun. 17, 1999

(51) Int. Cl.[7] ..... E04C 2/34

(52) U.S. Cl. ..... 52/794.1; 52/309.11; 52/309.12; 52/309.7

(58) Field of Search ..... 52/309.11, 309.12, 52/426, 79.9, 309.7, 405.2, 794.1, 795.1

(56) References Cited

U.S. PATENT DOCUMENTS

| | | | |
|---|---|---|---|
| 1,958,049 | | 5/1934 | Kleitz . |
| 2,412,744 | | 12/1946 | Nelson . |
| 2,645,929 | | 7/1953 | Jones . |
| 2,653,469 | | 9/1953 | Callan . |
| 2,775,018 | | 12/1956 | McLaughlin . |
| 3,274,680 | | 9/1966 | Cruse . |
| 3,426,494 | | 2/1969 | Hala . |
| 3,750,355 | | 8/1973 | Blum . |
| 3,927,857 | | 12/1975 | Lovisa et al. . |
| 3,965,635 | | 6/1976 | Renkert . |
| 4,052,831 | | 10/1977 | Roberts et al. . |
| 4,109,436 | | 8/1978 | Berloty . |
| 4,283,896 | | 8/1981 | Fricker et al. . |
| 4,290,246 | * | 9/1981 | Hilsey ..... 52/169.1 |
| 4,329,821 | | 5/1982 | Long et al. . |
| 4,348,847 | | 9/1982 | Jukes . |
| 4,348,848 | | 9/1982 | Denzer . |
| 4,393,635 | | 7/1983 | Long . |
| 4,489,530 | | 12/1984 | Chang . |
| 4,545,163 | | 10/1985 | Asselin . |
| 4,624,089 | | 11/1986 | Dunker . |
| 4,632,796 | | 12/1986 | Moulet . |
| 4,669,240 | | 6/1987 | Amormino . |
| 4,702,053 | | 10/1987 | Hibbard . |
| 4,805,366 | | 2/1989 | Long . |
| 4,829,733 | | 5/1989 | Long . |
| 4,974,381 | | 12/1990 | Marks . |
| 5,519,973 | | 5/1996 | Keith et al. . |
| 5,588,272 | | 12/1996 | Haponski . |
| 5,596,853 | | 1/1997 | Blaney et al. . |
| 5,671,574 | | 9/1997 | Long . |
| 5,673,525 | * | 10/1997 | Keith et al. ..... 52/309.11 |
| 5,697,189 | * | 12/1997 | Miller et al. ..... 52/79.9 |
| 5,822,939 | * | 10/1998 | Haener ..... 52/405.2 |
| 5,890,337 | * | 4/1999 | Boeshart ..... 52/426 |
| 5,927,032 | * | 7/1999 | Record ..... 52/309.11 |
| 5,987,834 | * | 11/1999 | Keith et al. ..... 52/410 |

FOREIGN PATENT DOCUMENTS

| | | |
|---|---|---|
| 1 683 498 | 9/1967 | (DE) . |
| 2 360 723 | 7/1977 | (FR) . |
| 2 670 523 | 12/1990 | (FR) . |

* cited by examiner

*Primary Examiner*—Christopher T. Kent
*Assistant Examiner*—Jennifer I. Thissell
(74) *Attorney, Agent, or Firm*—Zarely, McKee, Thomte, Voorhees & Sease

(57) ABSTRACT

Precast insulated concrete wall panels are made by pouring a first concrete layer into a form. An insulation layer is then supported above the first concrete layer so as to create a space therebetween. The second concrete layer is then poured on top of the insulation layer before the first concrete layer has cured. Connectors are anchored in the first and second concrete layers so as to tie the layers together. After the first and second concrete layers have cured, the wall panels can be lifted, transported, and assembled into a wall structure. An intermediate layer of concrete can be poured into the air gap of the wall panels such that the panels define the form for the intermediate concrete layer and become an integral part of the wall structure. The wall structure may extend below or above grade and may be multi-tiered. The edges of the wall panels are contoured so as to interlockingly matingly engage when assembled into the wall structure. Notches may be provided in the upper edge of the wall panels so as to receive floor or roof joists.

15 Claims, 9 Drawing Sheets

INSULATED INTEGRAL CONCRETE WALL FORMING SYSTEM

BACKGROUND OF THE INVENTION

Precast insulated concrete wall panels are well known in the art and offer a number of advantages for residential and commercial building construction. These advantages include shorter construction schedules, improved thermal resistance, improved quality control, and enhanced durability. However, conventional concrete wall panels are heavy, thus increasing the cost of transporting the panels from the precasting plant to the job site. The large weight of the panels often times requires multiple loads to be delivered to the job site, thereby resulting in potential delays during loading, transportation, and unloading. The large weight also requires the use of an expensive, heavy crane for panel installation.

Insulated concrete wall panels with cavities are also known in the art. These wall panels include inner and outer concrete layers, or wythes, with an internal insulation layer and an air gap provided between the concrete layers, so as to be lighter weight than solid walls of the same thickness. Such hollow insulated wall panels are made by separate castings of the first and second concrete layers, with the first concrete layer being completely cured or hardened before the second concrete layer is poured. This construction method involves long delays and increased costs for the production process.

Furthermore, the prior art concrete wall panels are normally butted side to side with additional panels so as to form a wall structure. However, such a butt joint is not interlocked and thereby complicates the assembly process. In addition, the prior art concrete wall panels are constructed using metallic connectors with high thermal conductives.

Accordingly, a primary objective of the present invention is the provision of an improved method of forming concrete wall panels.

Another objective of the present invention is the provision of an improved hollow concrete wall panel.

A further objective of the present invention is the provision of a lightweight insulated wall panel useful in forming an integral concrete wall structure.

A further objective of the present invention is the provision of a hollow concrete wall panel wherein the inner and outer concrete layers are cured substantially simultaneously.

Another objective of the present invention is the provision of precast wall panels which can be loaded, transported, unloaded, and assembled at the construction site using lightweight construction equipment.

Another objective of the present invention is an improved wall system that can be quickly and easily assembled at the construction site.

Another objective of the present invention is the provision of a quick and easy method of a precasting concrete wall panels.

A still further objective of the present invention is the provision of an improved concrete wall panel with a high degree of thermal insulation.

A further objective of the present invention is an improved concrete wall panel which is economical to manufacture and durable and safe in use.

These and other objectives become apparent from the following description of the invention.

SUMMARY OF THE INVENTION

The precast concrete wall panels of the present invention include inner and outer concrete layers, an internal insulation layer, and an air gap between the insulation layer and one of the concrete layers. In constructing the wall panels, the first concrete layer is poured into a form. The insulation layer is supported in a spaced relation above the first concrete layer, and the second concrete layer is poured on top of the insulation layer while the first concrete layer is still wet. Thus, the first and second concrete layers cure substantially simultaneously. A plurality of connectors or rods extend through the foam with opposite ends embedded in the first and second concrete layers. An enlarged flange on each connector supports the insulation layer above the first concrete layer to provide an air gap therebetween.

After the concrete layers have hardened, the wall panels can be lifted and installed in a vertical orientation on footings or another base. The edges of the panels are contoured, so as to matingly engage with a corresponding edge on an adjacent panel, thereby providing an interlocking joint between adjacent panels. The panels can be assembled adjacent one another and on top of one another so as to provide a form which becomes an integral part of the wall structure. The assembled panels create a continuous form, with the air gap in the panels being filled with concrete.

The upper edges of the inner concrete layer may include a notch to receive a floor or roof joist. The joists are thus supported by the inner concrete layer of the wall panels without the need for a ledger beam attached to the inside face of the wall panels. The thickness of the insulation layer can be determined based upon thermal insulation requirements as well as upon mechanical requirements for the insulation material acting as a concrete form. Where required for mechanical purposes, enhanced insulation material may be used incorporating fiber reinforcement, surface laminations, increased density or combinations thereof.

DETAILED DESCRIPTION OF THE DRAWINGS

Figure 1:
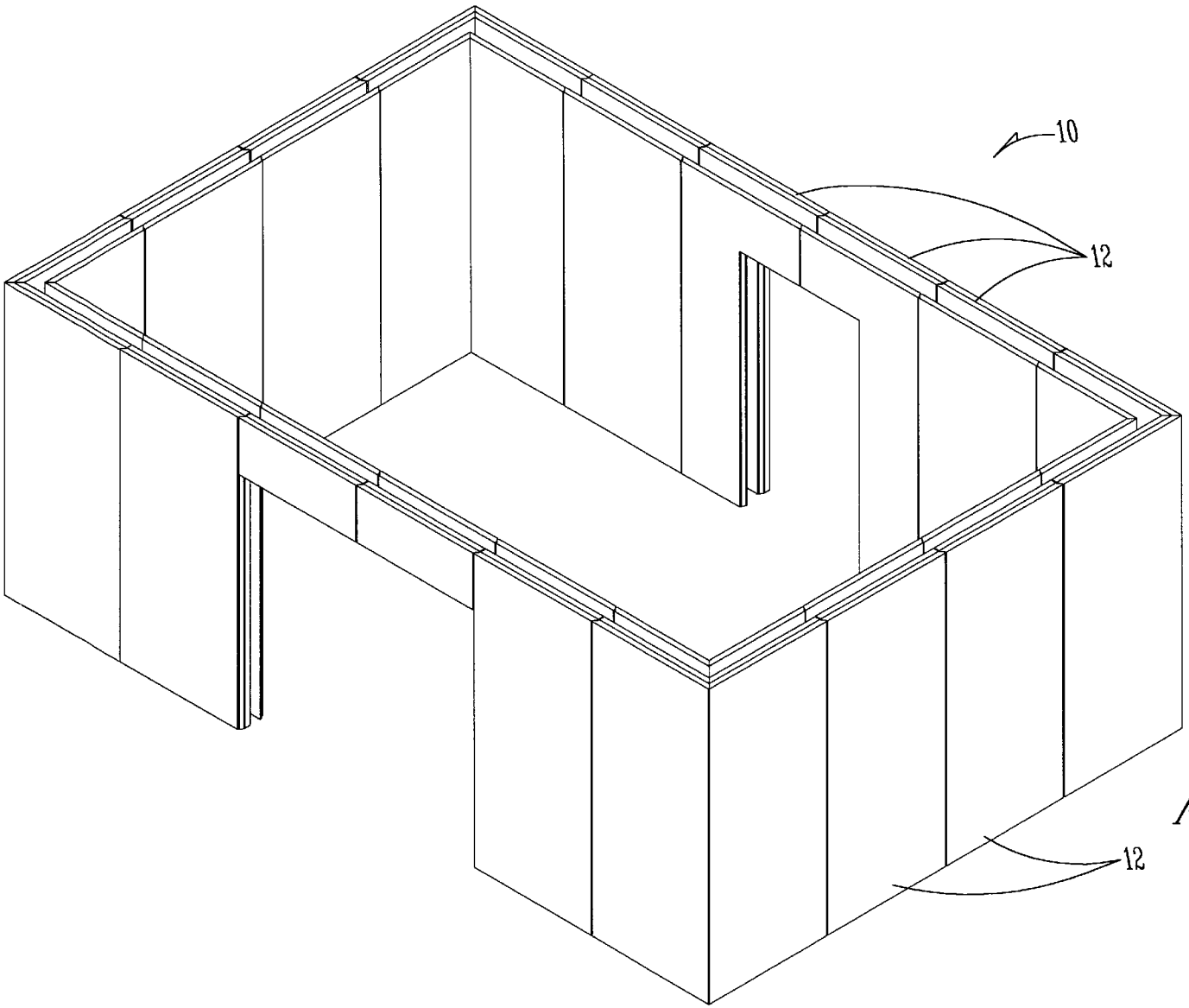
FIG. 1 is a perspective view showing a plurality of wall panels according to the present invention assembled so as to create an insulated integral concrete wall forming system.
Figure 2:
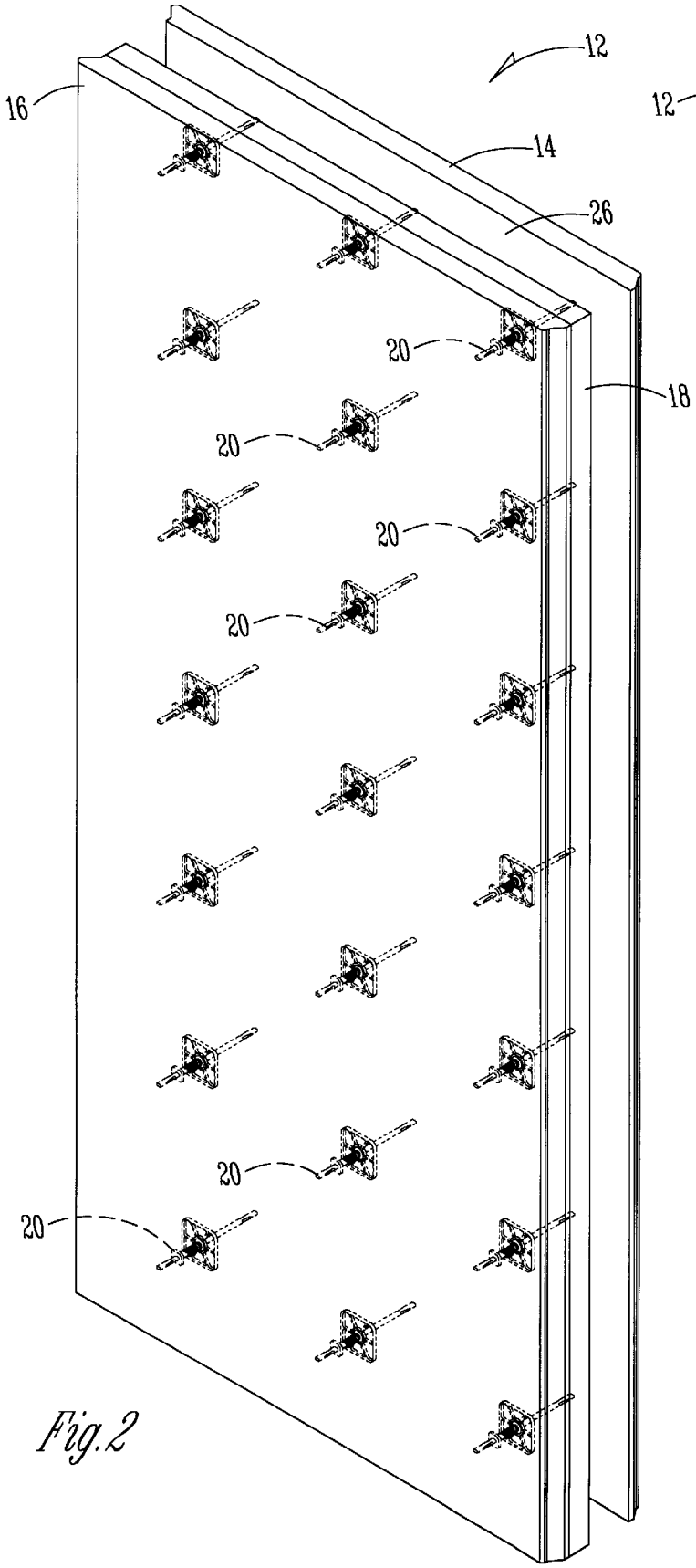
FIG. 2 is a perspective view of a single wall panel according to the present invention.
Figure 3:
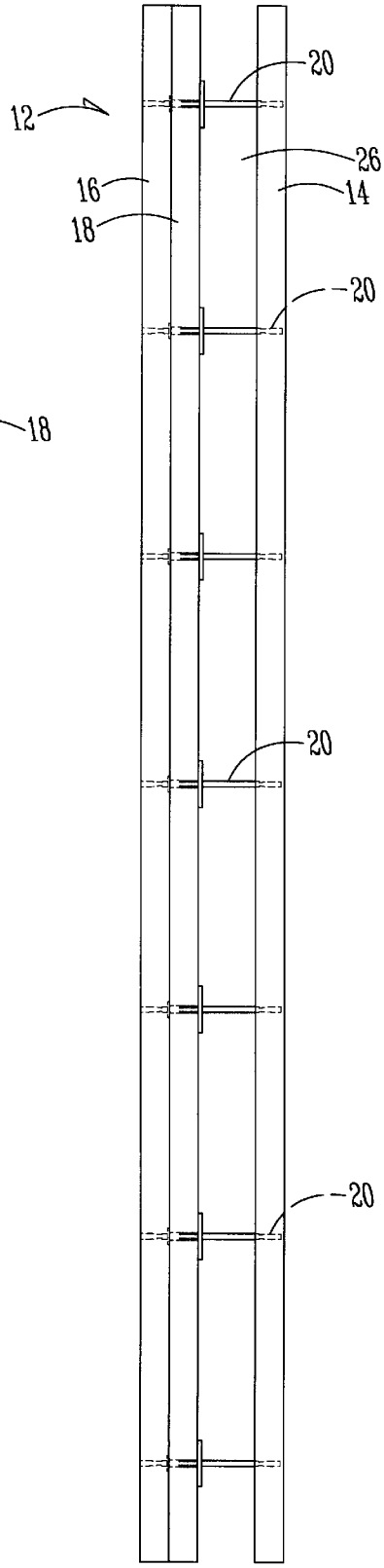
FIG. 3 is a side elevation view of a wall panel according to the present invention.

As seen in FIG. 1, a wall structure in accordance with the present invention is generally designated by the reference numeral 10. The wall structure 10 is formed from a plurality of hollow wall panels 12. As best seen in FIGS. 2 and 3, each wall panel 12 includes an inner concrete layer 14, an outer concrete layer 16, and an interior insulation layer 18. Concrete layers 14 and 16 may be constructed with reinforcement, such as wire fabric, reinforcing bars, or fiber reinforcing. A plurality of rods or connectors 20 extend through the wall panels 12 to tie together the inner and outer concrete layers 14, 16. The connectors 20 include opposite ends 21, 22 with a varying dimension so as to provide an anchoring surface to anchor the connectors 20 in the inner and outer concrete layers 14, 16. The connectors 20 are described in detail in applicant's U.S. Pat. No. 4,829,733, which is incorporated herein by reference. The connectors 20 have a high R value so as to have low thermal conductivity, thereby enhancing the thermal efficiency of the wall structure 10.

Figure 4:
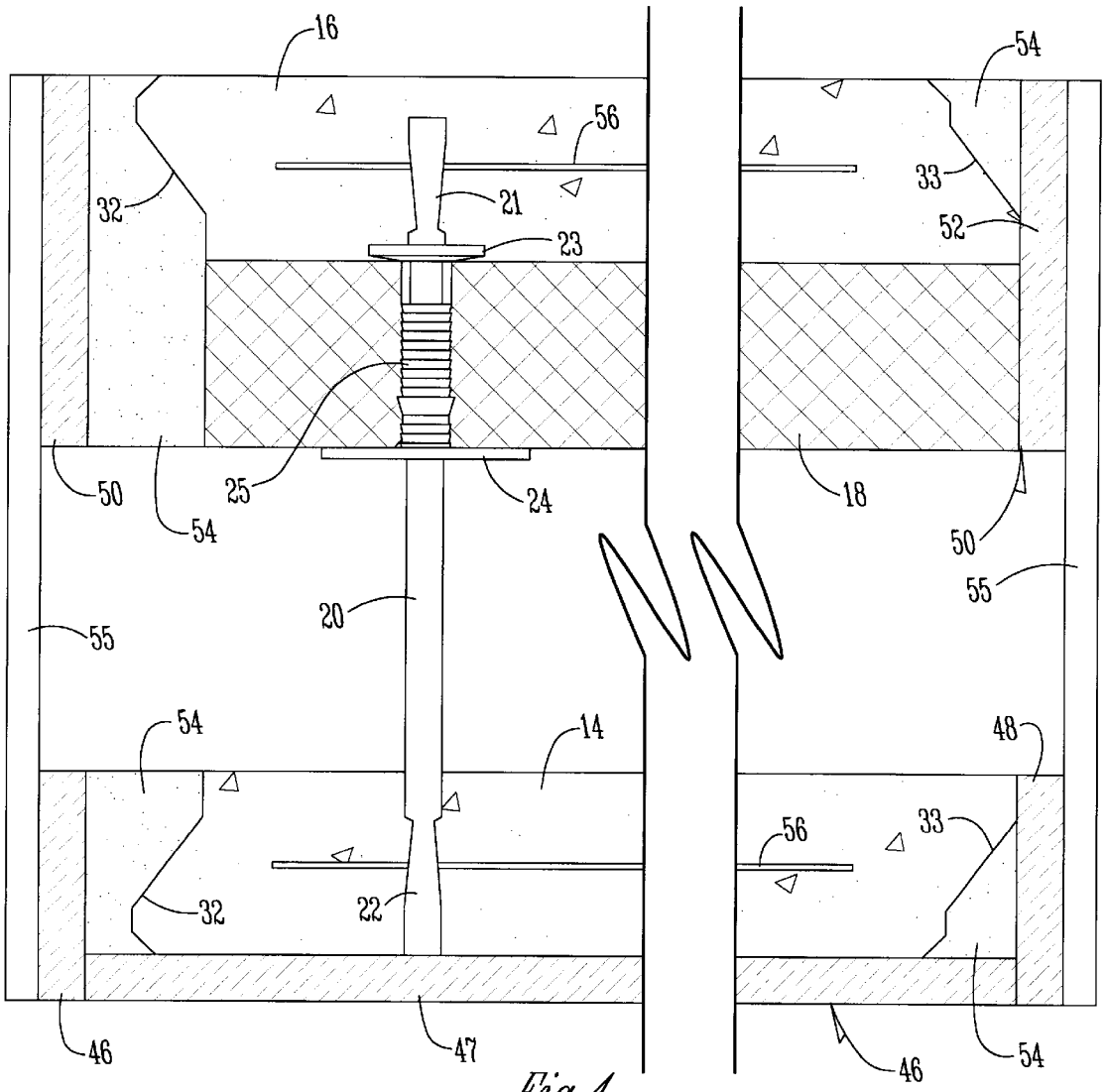
FIG. 4 is an enlarged side elevation view of the wall panel as cast in a concrete casting form.

The insulation layer 18 includes predrilled holes 19 through which the connectors 20 are inserted. The connectors include an upper flange 23, which limits the insertion of the connections through the predrilled holes 19 in the insulation layer 18. After insertion, a lower flange or button 24 is slid over the lower end 22 of the connectors and into engagement with the insulation layer, as best seen in FIG. 4. The lower flange 24 is retained in a non-slip position by a snap fit on the ridges 25 formed on the central portion of the connector 20. Insulation layer 18 may comprise any thermally efficient material capable of spanning between connectors 20 without excessive deformation or fracture.

Each wall panel 12 is hollow, with an air gap or space 26 between the insulation layer 18 and the inner concrete layer 14. When the wall panels 12 are assembled into the wall structure 10, the panels 12 serve as a concrete form, with concrete being poured into the air gap 26 so as to form a continuous intermediate concrete layer 27 between the inner concrete layer 14 and the insulation layer 13 of the panels 12. Accordingly, the panels 12 become an integral part of the insulated wall structure 10.

It is apparent that the air gap 26 can be partially filled with concrete. It is also apparent that the air gap 26 can be filled with bat, granular, or foamed-in-place insulation.

Figure 9:
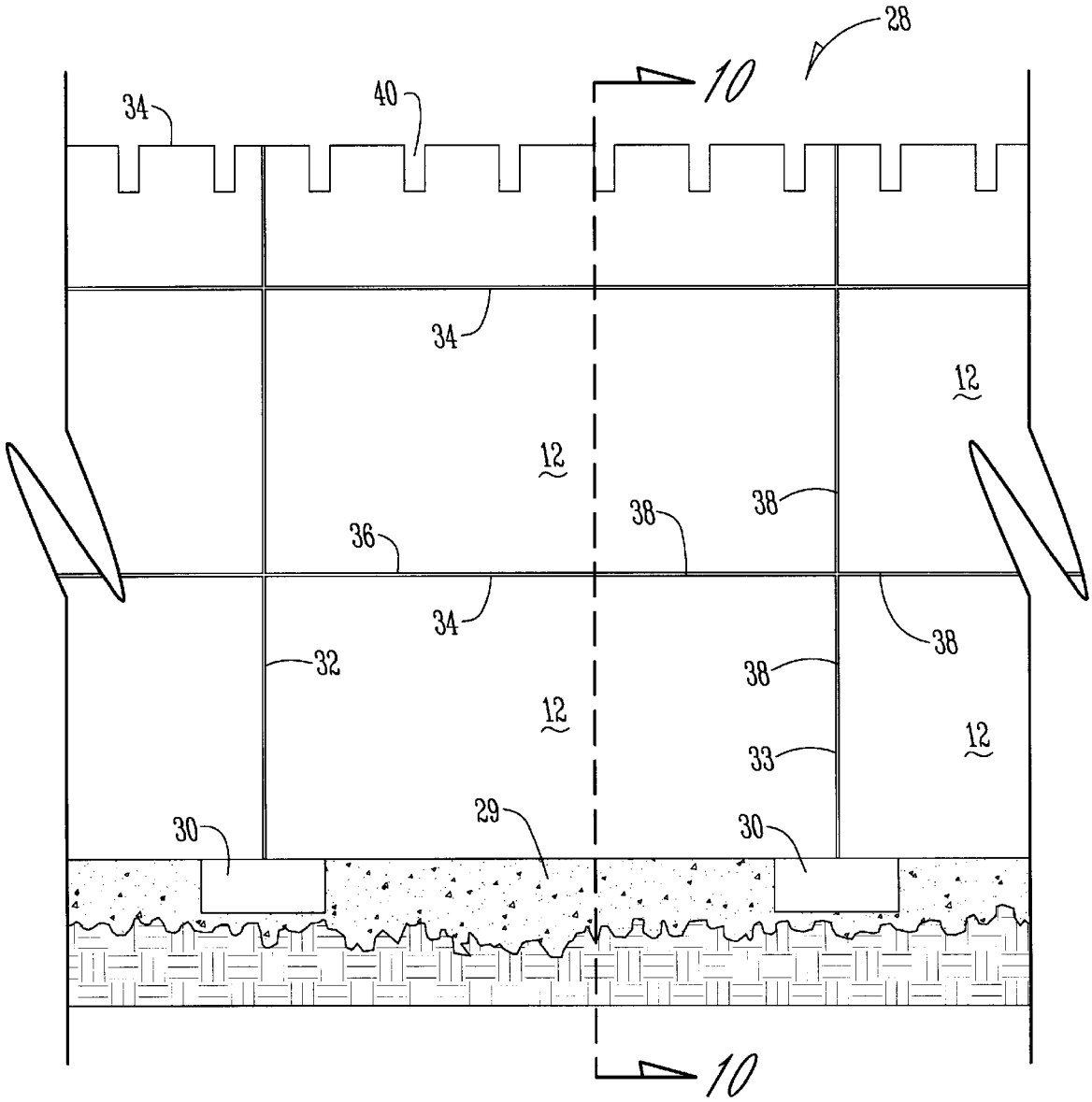
FIG. 9 is a side elevation view showing a plurality of wall panels assembled in multiple tiers and showing an alternative embodiment of the wall panel having a notch for receiving a floor or roof joist.

In addition to the wall structure 10 shown in FIG. 1 wherein the panels are assembled side by side, the wall panels 12 may also be stacked one on top of one another so as to form a multi-tier wall structure 28, as shown in FIG. 9. The panels may be assembled on top of conventional footings (not shown), or on top of a compacted base material 29, such as limestone, with shims 30 being used to level the panels 12. After placement of the concrete layer 27, the assembled wall panels have continuous bearing on the compacted subgrade. The wall structure 10 can be built below grade, such as basement or foundation walls, or above grade for any type of building structure, including commercial and residential buildings.

Preferably, the panels 12 are rectangular in shape, with major and minor axes. The major axis of each wall panel may be oriented vertically, as shown in the wall structure 10 of FIG. 1, or horizontally as in the wall structure 28 of FIG. 9.

It is important to note that a continuous concrete layer 27 will provide an effective barrier against insect, rodent and moisture intrusion. The present invention therefore provides the advantages of a monolithic, cast-in place structure. The common disadvantages of precast concrete, including open joints and welded or bolted connections are, however, avoided. When required to resist large lateral forces, additional reinforcing may be added to concrete layer 27.

To facilitate the assembly of the wall panels 12 into the wall structure 10 or 28, the opposite side edges 32, 33 are contoured, so as to provide an interlocking mating engagement between adjacent panels 12. Also, the upper edge 34 and lower edge 36 may also be contoured so as to matingly engage the corresponding edge of an adjacent panel. Thus, an interlocked joint 38 is provided between the adjacent panels 12 with forward and rearward relative movement of the panels being inhibited by the matingly engaged contoured edges 32, 33, 34, 36. The contoured edges of the wall panels 12 may take various shapes which provide overlapping mating engagement. In comparison, in prior art panels, the edges are flat so as to provide a butt joint which does not preclude relative movement of the adjacent panels with respect to one another.

Figure 10:
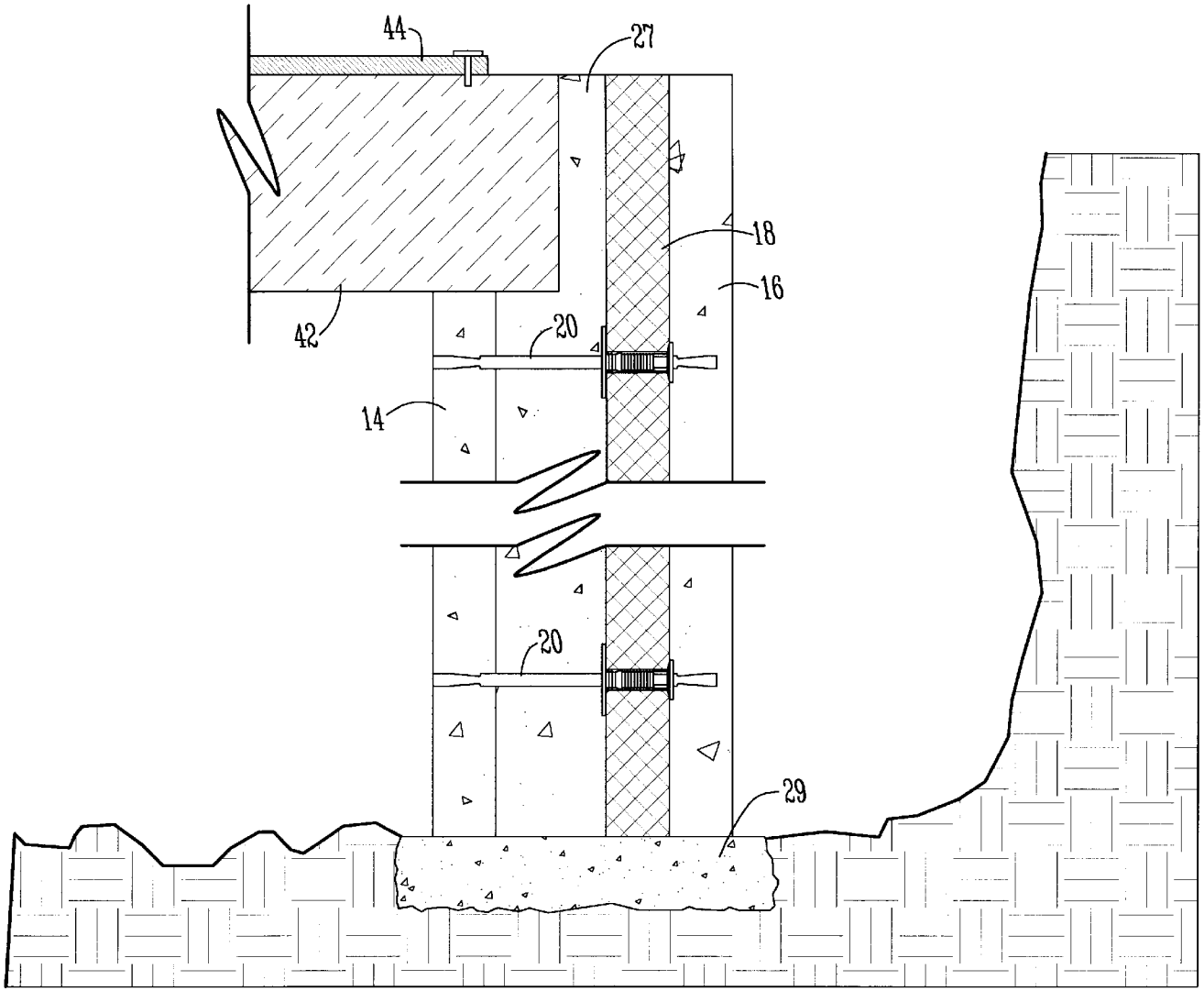
FIG. 10 is a sectional view taken along lines 10—10 of FIG. 9, with floor joists and floor decking installed.

As seen in FIGS. 9 and 10, the upper edge 34 of the wall panels 12 may also be provided with a plurality of notches 40 adapted to receive floor or wall joists 42. The joists 42 are supported by the inner concrete layer 14 and may be any known construction. The joists 42 are preferably positioned in the notches 40 of the wall panels 12 before the intermediate concrete layer 27 is poured. The ends of the joists 42 may extend into the air gap 26, as seen in FIG. 10. An anchoring surface may extend from the ends of the joists or be formed therein so as to anchor the joints in the intermediate concrete layer 27. For example, the anchoring surface may be a nail or bolt in the end of the joist 42, or may be a varying dimension formed in the end of the joist 42. Decking material 44 may be attached to the joists 42 before the intermediate concrete layer 27 is poured. By installing the floor or roof joists in the notches 40, the need for a ledger beam on the wall is eliminated. By installing the joists and the decking material 44 before concrete layer 27 is poured, the wall panels 12 are braced during the pouring process. Further, the decking material 44 provides a safe work platform at the top of the wall structure 10 or 28.

To complete the assembly, the joints between the contoured edges 32, 33, 34, 36 may be filled with a rigid or flexible material that cures in place.

The present invention is also directed towards the method of making the wall panels 12. The panels are precast, using a form, as shown in FIG. 4. More particularly, a lower form section 46 is provided with a bottom, and a perimeter edge 48. An upper form section 50 includes only a perimeter edge 52. An appropriate profile 54 is provided along the perimeter edges 48, 52 of the lower and upper form sections 46, 50 so as to create the contoured edges 32, 33, 34 and 36 of the panels 12.

In making the wall panels 12, the inner concrete layer 14 is poured into the lower form section 46. A screed may be run across the perimeter edge 48 to smooth and level the surface of the inner concrete layer 14, as seen in FIG. 4. The upper form section 50 may then be attached to the lower form section 46 in any conventional manner, such as with side braces 55. The insulation layer 18 with the pre-installed connectors 20 are then set into the upper form section 50 with the lower ends 22 of the connectors 20 extending through the wet inner concrete layer 14. The lower ends 22 of the connectors 20 rest upon the bottom 47 of the lower form 46, with the lower flange 24 of the connectors 20 supporting the insulation layer in a spaced relation above the inner concrete layer 14, thereby defining the air gap 26. The upper form 50 may also have an inwardly extending lip (not shown) to support the insulation layer 18. The insulation layer also serves as the bottom of the upper form section 50. The outer concrete layer 16 is then poured into the upper form section 50, before the inner concrete layer 14 cures.

Thus, the outer concrete layer 16 is poured substantially immediately after the inner concrete layer 14 is poured, and both layers 14, 16 cure substantially simultaneously. Accordingly the time required to manufacture the wall panels is minimized, without any delays waiting for the first poured concrete layer to cure before the second layer is poured, as in the prior art. After both concrete layers have cured, the forms 46, 50 can be stripped from the panel 12. Lifting tabs (not shown) may be cast into the outer concrete layer 16 for attaching a cable for lifting the finished panel 12. However, in the preferred embodiment, connectors 20 have sufficient strength to be used as attachment points for lifting cables.

As seen in FIG. 4, reinforcing fibers 56 may be provided throughout the inner and outer concrete layers 14, 16.

Figure 5:
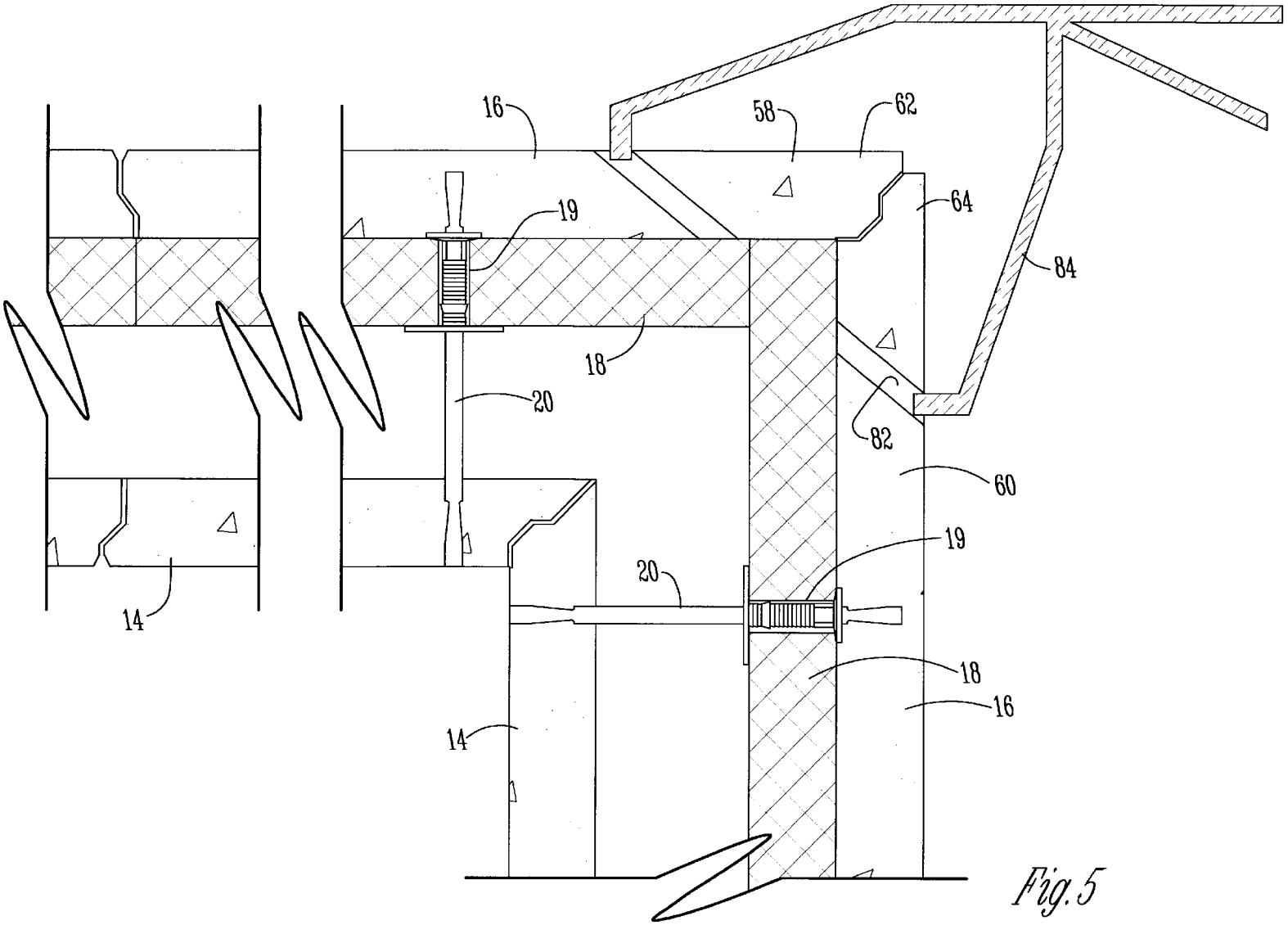
FIG. 5 is an enlarged top plan view of one corner of the wall structure shown in FIG. 1.

FIGS. 5–8 show various alternatives for the corners of the wall structure 10. In FIG. 5, the corner panels 58, 60 are formed with 45-degree edges 62, 64, each of which are contoured to provide an interlocking miter joint. As an alternative shown in FIG. 6, one corner panel 66 is formed with a contoured edge 68 while the adjacent corner panel 70 is formed with a contoured surface 72 for interlocking mating engagement with the edge 68. As another alternative shown in FIG. 7, the corner panels 74, 76 are provided with contoured interlocking edges 78, 80, respectively.

Figure 6:
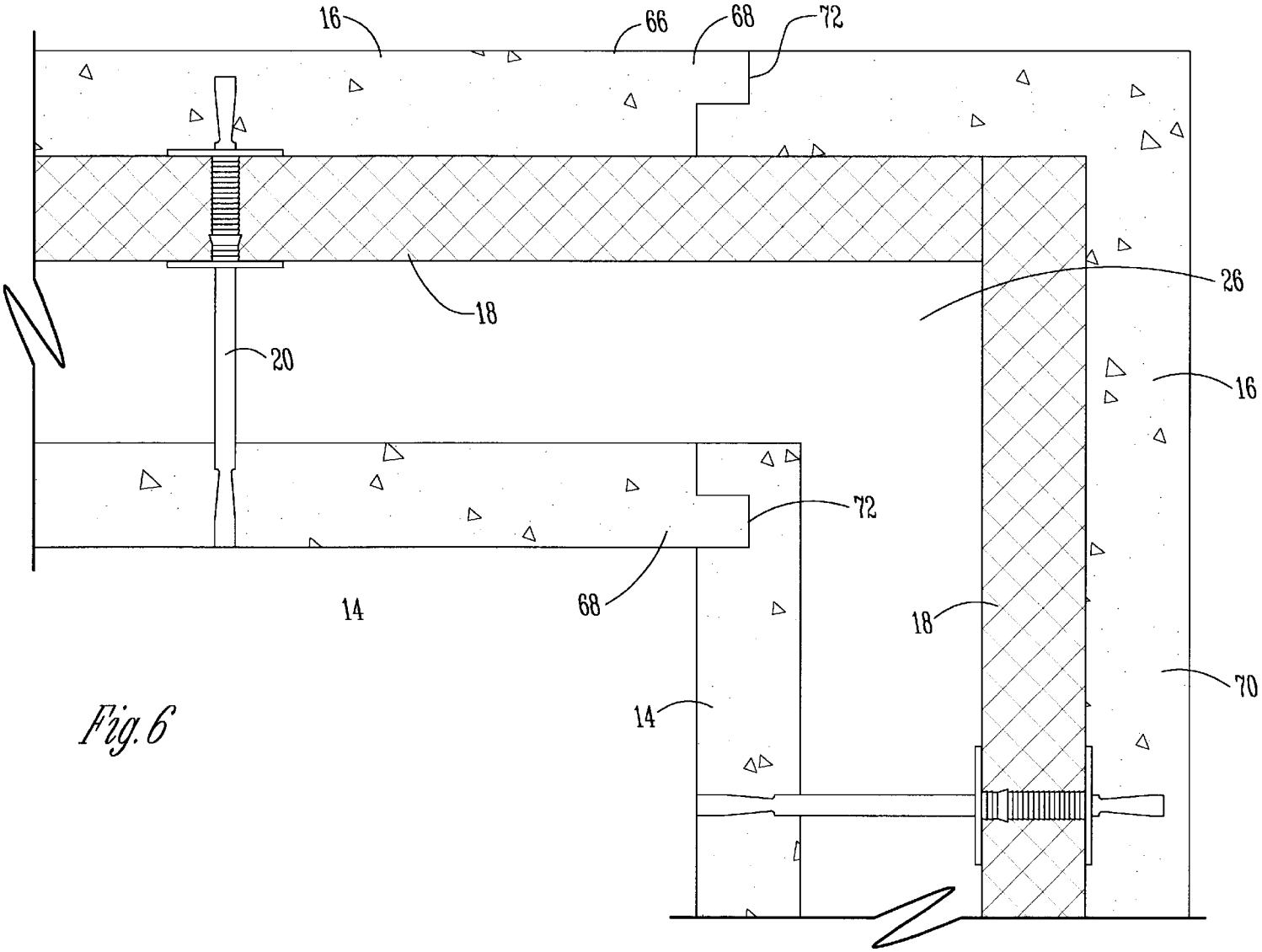
FIG. 6 is a view similar to FIG. 5, showing an alternative corner construction.
Figure 7:
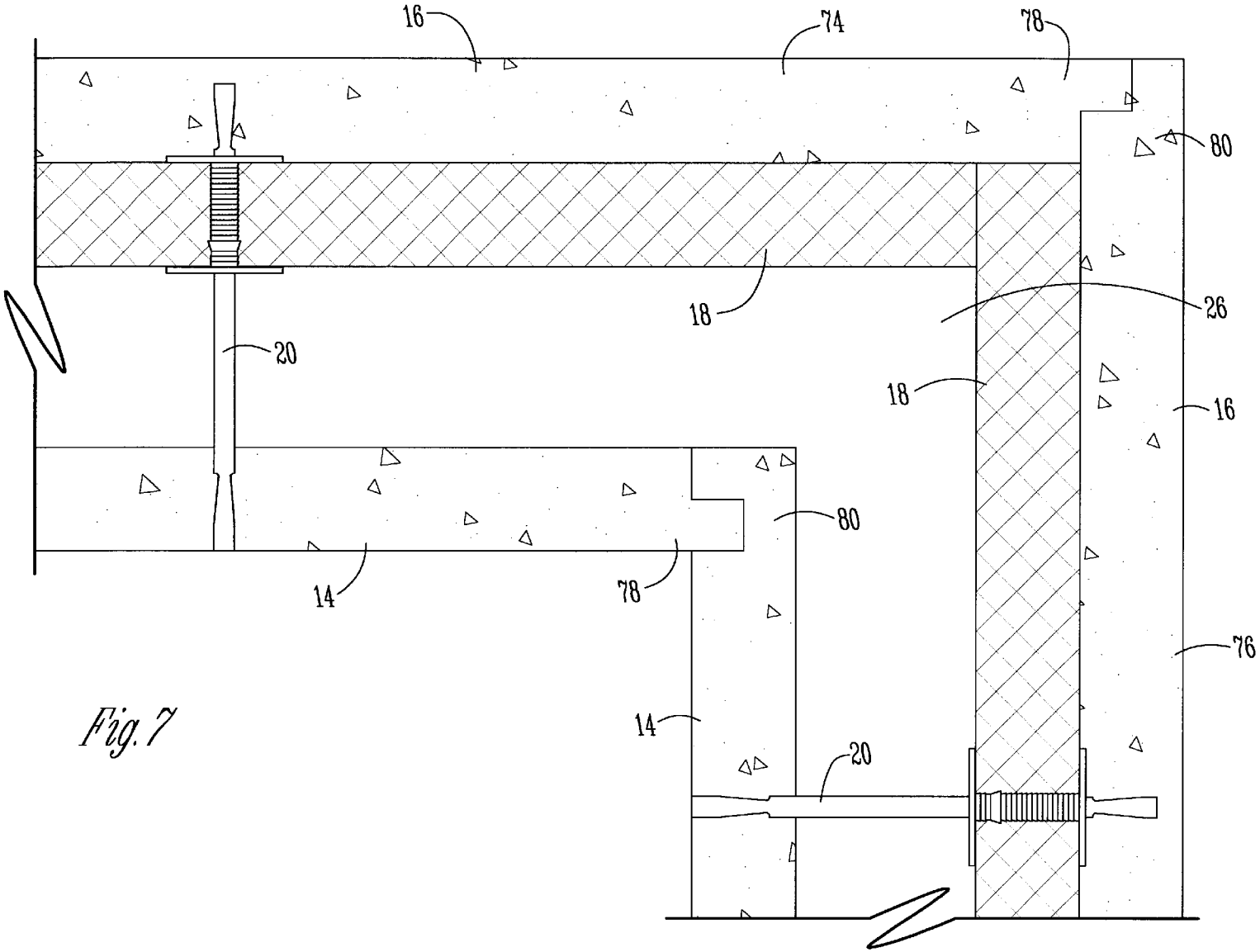
FIG. 7 is a view similar to FIG. 5, showing a second alternative embodiment for a corner construction.

In each of the corner panels shown in FIGS. 5–7, the mating edges will tend to separate by the pressure of the intermediate concrete layer 27 when the intermediate layer is poured into the air gap 26. Accordingly, the corner panels 58, 60, 66, 70 and 74, 76 are clamped or tied together in a convenient fashion. For example, as seen in FIG. 5, a recess or hole 82 is provided in the outer concrete layer 16 for receiving a clamp 84, or a bolt or tie (not shown) extending through the hole 82. A plurality of spaced apart recesses or holes 82 are provided along the height of the panel for multiple clamps, bolts, or ties.

Figure 8:
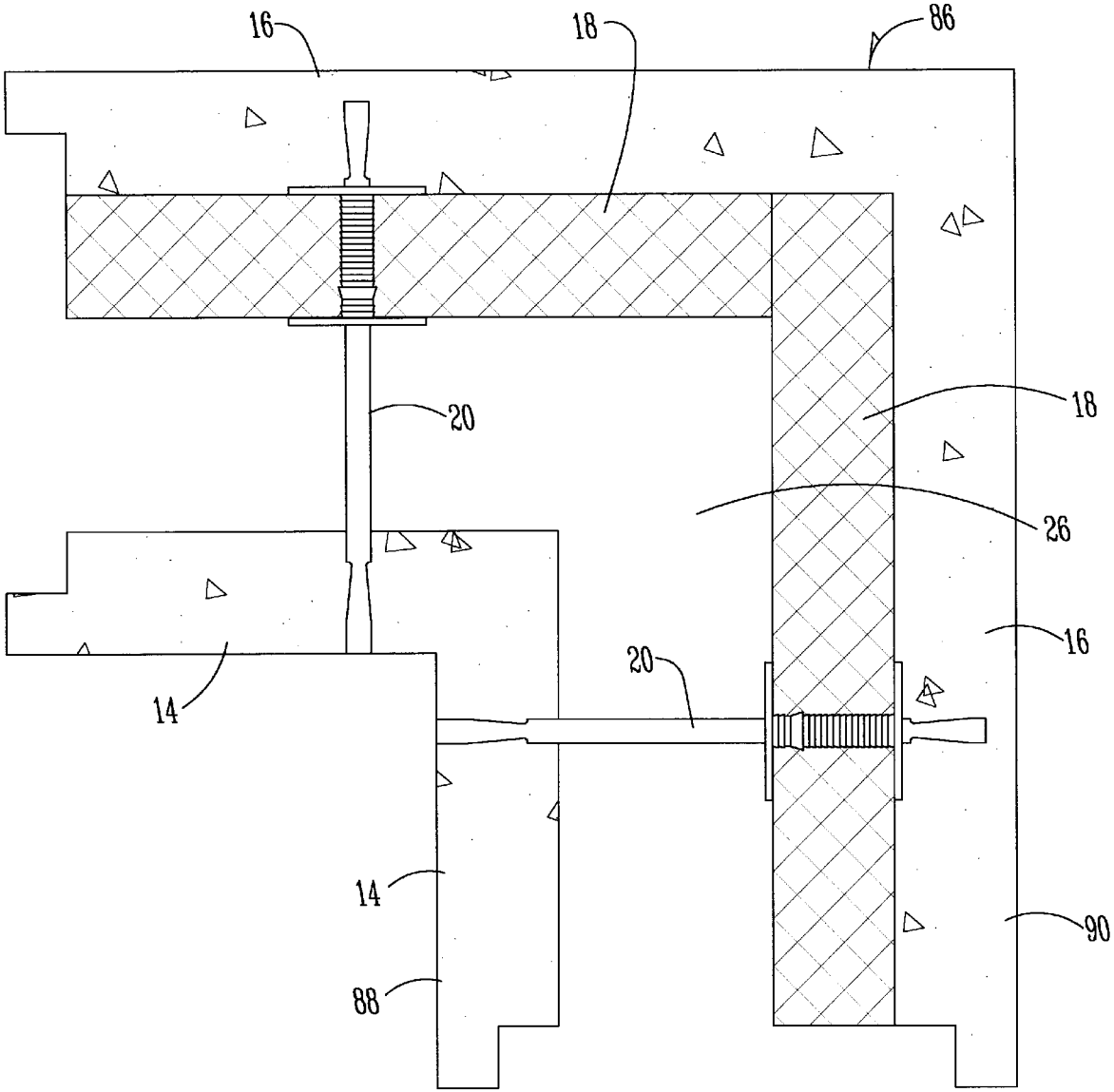
FIG. 8 is a view similar to FIG. 5, showing a third alternative corner construction.

As a further alternative, as shown in FIG. 8, a corner panel 86 may be used at the corners of the wall structure 10. The corner panel 86 is similar to the flat panels 12, except that the inner and outer concrete layers 88, 90 are formed with angled sections.

It is understood that corner panels can be used to form interior 90° corners as well as 45° and other angles.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A method of making a wall panel, comprising:

pouring a first concrete layer into a form with a perimeter edge and a bottom;

supporting an insulation layer above the first concrete layer so as to create a space therebetween, the support being provided by a plurality of connectors extending through the insulation layer and having a first end extending through the first concrete layer to engage the bottom of the form;

pouring a second concrete layer on top of the insulation-layer before the first concrete layer has cured, the connectors having a second end extending into the second concrete layer; and curing the first and second layers substantially simultaneously.

2. The method of claim 1 wherein the connectors are installed in the insulation layer and then the insulation layer is placed in the form for support above the first concrete layer.

3. The method of claim 1 wherein the concrete layers are poured in a horizontal orientation.

4. The method of claim 1 further comprising forming a contoured edge on at least one of the first and second concrete layers.

5. A wall panel made in accordance with the method of claim 1.

6. A wall panel comprising:

a first concrete layer;

a second concrete layer cured substantially simultaneously with the first concrete layer;

an insulation layer adjacent to second concrete layer;

an air gap between the insulation layer and the first concrete layer; and a plurality of connectors each having a first end extending through the first concrete layer, to support the insulation layer in spaced relation to the first concrete layer so as to define the air gap, and a second end embedded in the second concrete layer without extending through the second concrete layer.

7. The wall panel of claim 6 wherein the first concrete layer has opposite inner and outer sides, with the first end of each of the connectors extending through the first concrete layer from the inner side to the outer side thereof.

8. The wall panel of claim 6 wherein each connector includes a flange for supporting the insulation layer in spaced relation to the first concrete layer.

9. The wall panel of claim 6 wherein each connector end has an anchoring surface for anchoring the connector ends in the respective concrete layers.

10. The wall panel of claim 6 wherein at least one of the concrete layers has a contoured edge adapted to matingly engage with a corresponding contoured edge of an adjacent wall panel.

11. The wall panel of claim 10 wherein the adjacent panels are co-linear to one another.

12. The wall panel of claim 10 wherein the adjacent panels are angularly disposed with respect to one another so as to form a corner of a wall structure.

13. The wall panel of claim 10 wherein the mating edges of adjacent panels interlock.

14. The wall panel of claim 6 wherein the first concrete layer has an upper edge with at least one notch adapted to receive a floor joist for support on the first concrete layer.

15. The wall panel of claim 6 wherein the concrete layers are formed with portions oriented at angles relative to each other so as to form a corner for a wall structure.

* * * * *